US008839636B2

(12) United States Patent
Hamada et al.

(10) Patent No.: US 8,839,636 B2
(45) Date of Patent: Sep. 23, 2014

(54) HEAT PUMP WATER HEATER AND OPERATING METHOD THEREOF

(75) Inventors: Mamoru Hamada, Chiyoda-ku (JP); Fumitake Unezaki, Chiyoda-ku (JP); Yusuke Tashiro, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 281 days.

(21) Appl. No.: 13/125,906

(22) PCT Filed: Dec. 2, 2009

(86) PCT No.: PCT/JP2009/006533

§ 371 (c)(1),
(2), (4) Date: Apr. 25, 2011

(87) PCT Pub. No.: WO2010/070828

PCT Pub. Date: Jun. 24, 2010

(65) Prior Publication Data

US 2011/0197600 A1 Aug. 18, 2011

(30) Foreign Application Priority Data

Dec. 16, 2008 (JP) ..... 2008-319184

(51) Int. Cl.

| | |
|---|---|
| ***F25B 30/02*** | (2006.01) |
| ***F25B 13/00*** | (2006.01) |
| ***F25B 47/02*** | (2006.01) |
| ***F24H 4/04*** | (2006.01) |

(52) U.S. Cl.

CPC *F24H 4/04* (2013.01); *F25B 13/00* (2013.01); *F25B 2313/0234* (2013.01); *F24D 2200/12* (2013.01); *F25B 47/022* (2013.01); *F25B 2313/003* (2013.01); *F25B 2313/02741* (2013.01)

USPC ..... 62/156; 237/2 B; 126/421

(58) Field of Classification Search

USPC ..... 62/79, 80, 238.7; 237/2 B; 126/609–611, 361.1

See application file for complete search history.

(56) References Cited

U.S. PATENT DOCUMENTS 4,191,172 A * 3/1980 Walch et al. ..... 126/587
4,553,401 A 11/1985 Fisher (Continued)

FOREIGN PATENT DOCUMENTS

EP 0134015 3/1985
EP 0 240 441 10/1987

(Continued)

OTHER PUBLICATIONS

Chinese Office Action, dated Sep. 25, 2012, with English-language translation.

(Continued)

*Primary Examiner* — Cheryl J Tyler
*Assistant Examiner* — Antonio R Febles
(74) *Attorney, Agent, or Firm* — Buchanan Ingersoll & Rooney PC

(57) ABSTRACT

A refrigerant circuit of a heat pump water heater has a compressor, a four-way valve, a water heat exchanger, a heat storage transfer pipe contained in a heat storage water tank, an expansion valve, and an air heat exchanger and forms a refrigerating cycle by sequentially connecting them. A water circuit of the heat pump water heater has a water inlet pipeline that supplies water to the water heat exchanger, a hot water tank, and a water outlet pipeline that allows the water heat exchanger to communicate with the hot water tank, in which water is supplied to the heat storage water tank through a heat storage water tank water feed pipe branching from the water inlet pipeline by opening a heat storage water tank water feed opening/closing valve) and the water in the heat storage water tank can be discharged through the heat storage water tank water discharge pipe (by opening a heat storage water tank water discharge opening/closing valve).

5 Claims, 7 Drawing Sheets

(56) References Cited

U.S. PATENT DOCUMENTS

| | | | | |
|---|---|---|---|---|
| 7,454,919 | B2 * | 11/2008 | Ookoshi et al. | 62/156 |
| 2008/0276638 | A1 | 11/2008 | Seefeldt | |

FOREIGN PATENT DOCUMENTS

| | | | |
|---|---|---|---|
| JP | 63-148063 | A | 6/1988 |
| JP | 63-150568 | A | 6/1988 |
| JP | 1-127871 | A | 5/1989 |
| JP | 8-049938 | A | 2/1996 |
| JP | 2002-107028 | | 4/2002 |
| JP | 2002-228258 | A | 8/2002 |
| JP | 2002-372328 | | 12/2002 |
| JP | 2004-301469 | A | 10/2004 |
| JP | 2005-098649 | A | 4/2005 |
| JP | 2005-233596 | A | 9/2005 |
| JP | 2007-132632 | | 5/2007 |
| JP | 2008-185245 | A | 8/2008 |
| WO | WO 86/00976 | | 2/1986 |

OTHER PUBLICATIONS

International Search Report (PCT/ISA/210) issued on Mar. 16, 2010, by Japanese Patent Office as the International Searching Authority for International Application No. PCT/JP2009/06533.

Office Action issued on Nov. 30, 2010, by Japanese Patent Office for Application No. 2008-319184.

Office Action (Notification of Reasons for Refusal) dated Aug. 2, 2011, issued in the corresponding Japanese Patent Application No. 2008-319184, and an English Translation thereof.

Second Office Action dated Jun. 13, 2013 issued by the Chinese Patent Office in Chinese Patent Application No. 200980150221.4, and an English translation thereof.

May 28, 2014 European Search Report issued in European Patent Application No. 09833138.2.

* cited by examiner

HEAT PUMP WATER HEATER AND OPERATING METHOD THEREOF

TECHNICAL FIELD

The present invention relates to a heat pump water heater and an operating method thereof and more particularly to a heat pump water heater on which a defrosting operation system is mounted and an operating method thereof.

BACKGROUND ART

Hitherto, in a refrigerating cycle device in which a compressor that compresses a refrigerant, an indoor heat exchanger that condenses the compressed refrigerant, a decompressor that expands the refrigerant and an outdoor heat exchanger that evaporates the expanded refrigerant are connected sequentially in a ring state by refrigerant piping, if the outdoor temperature is low, frost adheres to the outdoor heat exchanger (hereinafter referred to as "frosting"), and various technologies have been conceived to remove the frost (hereinafter referred to as "defrosting").

For example, a method in which throttling of a refrigerant in a decompressor is relaxed while continuing a heating operation, and the refrigerant at a relatively high temperature is supplied to an outdoor heat exchanger for defrosting and a method in which the heating operation is stopped once, and the refrigerant compressed in the compressor is directly supplied to the outdoor heat exchanger by reversing the flow of the refrigerant for defrosting are known.

In the former case, in order to prevent the refrigerant whose temperature is lowered during the defrosting from returning to the compressor in a liquid state (hereinafter referred to as "liquid hack", an invention has been disclosed in which heat storage means is disposed between the indoor heat exchanger and the decompressor so that the warm heat stored during the heating operation is delivered to the refrigerant immediately before returning to the compressor during a defrosting operation (See Patent Documents 1 and 2, for example).

Citation List

Patent Literature

Patent Document 1: Japanese Unexamined Patent Application Publication No. 63-148063 (page 11 FIG. 1)
Patent Document 2: Japanese Unexamined Patent Application Publication No. 1-127871 (pages 3 to 4, FIG. 1)

SUMMARY OF INVENTION

Technical Problem

However, since calcium chloride hexahydrate as a latent heat storage material in the invention disclosed in Patent Document 1 and water, various types of paraffin, calcium chloride mixed salt and the like as a heat storage material using latent heat in the invention disclosed in Patent Document 2 are sealed in a heat exchanger (vessel) in advance, respectively, the weight of the refrigerating cycle device is increased. Thus, there are problems such that transportation is not easy, installation performance is worse, performance is lowered due to aging deterioration of the latent heat storage material (heat storage material using latent heat) (occurrence of liquid back, for example).

The present invention was made in view of the above problems and has an object to obtain a heat pump water heater which can suppress an increase of the entire weight and on which a defrosting operation system capable of suppressing lowered performance caused by aging deterioration of a latent heat storage material is mounted and an operating method thereof.

Solution To Problem

A heat pump water heater according to the present invention has a refrigerant circuit and a water circuit thermally connected through a refrigerant-water heat exchanger that performs heat exchange between a refrigerant and water, in which the refrigerant circuit includes a compressor, a four-way valve, the refrigerant-water heat exchanger, a heat exchanger for heat storage, expanding means, and a refrigerant-air heat exchanger, forms a water heating circuit composed by sequentially connecting the compressor, the four-way valve, the refrigerant-water heat exchanger, the heat exchanger for heat storage, the expanding means, the refrigerant-air heat exchanger, and the four-way valve, and forms a defrosting operation circuit composed by sequentially connecting the compressor, the four-way valve, the refrigerant-air heat exchanger, the expanding means, the heat exchanger for heat storage, the refrigerant-water heat exchanger, and the four-way valve by switching of the four-way valve, the water circuit includes the refrigerant-water heat exchanger and a hot water tank to which the wafer having passed the refrigerant-water heat exchanger is supplied, and the heat exchanger for heat storage is contained in a heat storage water tank that can supply and discharge the wafer.

Advantageous Effects of Invention

Since the present invention has the heat exchanger for heat storage and the heat storage water tank containing the same, by storing water in the heat storage water tank during a water heating operation so as to use the water as a heat source in the defrosting operation (specifically, the refrigerant having passed the expanding means is heated so as to prevent liquid back), a defrosting operation time can be reduced, and efficiency can be improved. Also, since the wafer to be a heat source is supplied during water heating, an increase in the product weight of the heat pump water heater itself (at the time of shipping or installation of the product) can be suppressed, and since the water that works as a heat storage material can be arbitrarily exchanged, lowered performance caused by aging deterioration can be suppressed.

BRIEF DESCRIPTION OF DRAWINGS

FIG. 13 is a configuration diagram for explaining an operating method of a heat pump water heater according to Embodiment 8 of the present invention.

DESCRIPTION OF EMBODIMENTS

Embodiment 1

Figure 1:
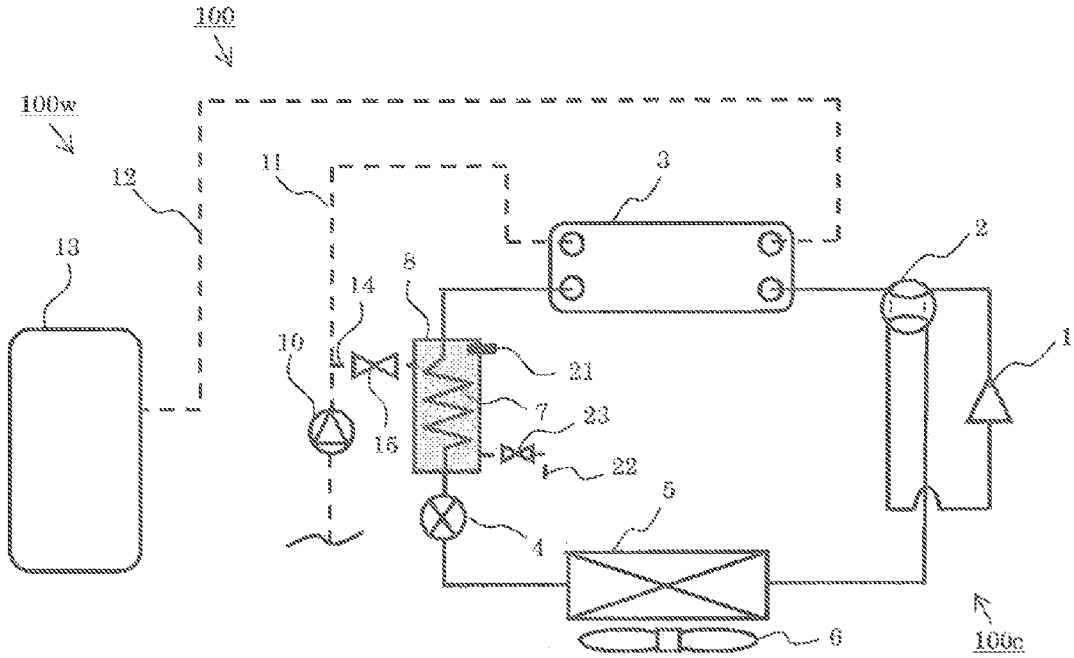
FIG. 1 is a configuration diagram for explaining a heat pump water heater according to Embodiment 1 of the present invention.
Figure 2:
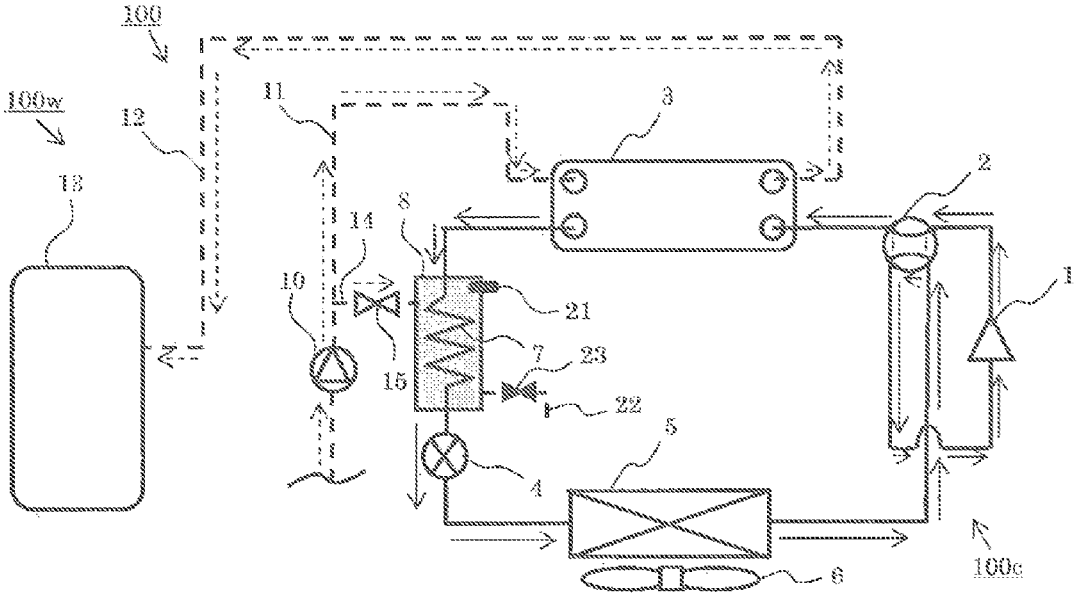
FIG. 2 is a configuration diagram illustrating flows of water and a refrigerant in FIG. 1.
Figure 3:
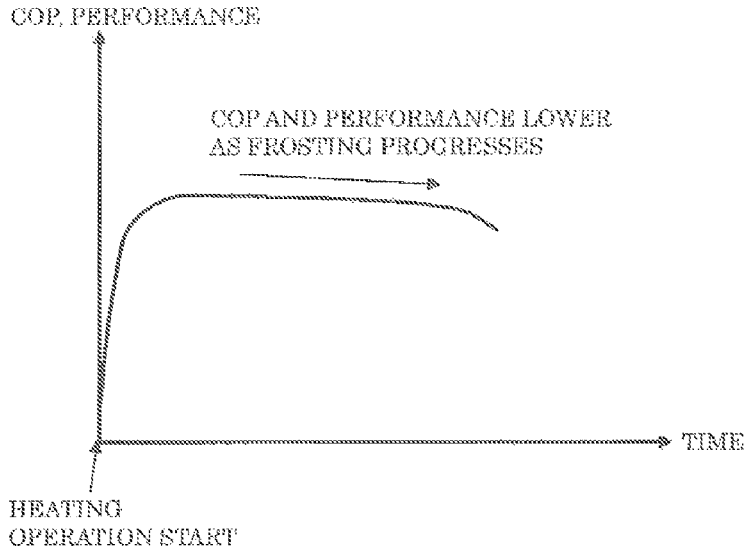
FIG. 3 is a performance curve illustrating a change over time of COP in the configuration shown in FIG. 1.
Figure 4:
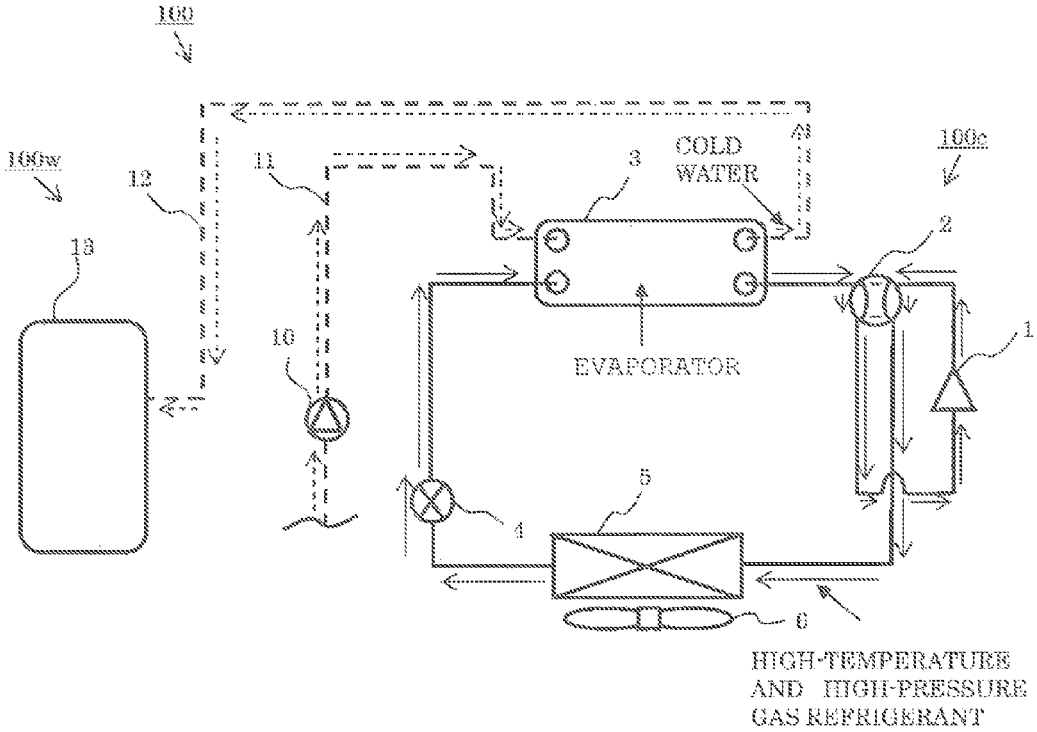
FIG. 4 is a configuration diagram Illustrating the flows of the water and the refrigerant in FIG. 1.

FIGS. 1 to 4 illustrate a heat pump water heater according to Embodiment 1 of the present invention, where FIG. 1 is a configuration diagram illustrating refrigerant circuit and water circuit configurations, FIG. 3 is a performance curve illustrating the change of COP over time, and FIGS. 2 and 4 are configuration diagrams illustrating flows of water and a refrigerant. In each figure, the same portions are given the same reference numerals and a part of the description is omitted.

In FIG. 1, a heat pump water heater 100 has a refrigerant circuit 100*c* and a water circuit 100*w*.

(Refrigerant Circuit)

The refrigerant circuit 100*c* has a compressor 1 that compresses the refrigerant, a four-way valve 2 that changes the flow of the refrigerant, a refrigerant-water heat exchanger that performs heat exchange between the refrigerant and water (hereinafter referred to as "water heat exchanger") 3, a heat exchanger for heat storage (hereinafter referred to as "heat storage transfer pipe") 7, an expansion valve 4 that expands the refrigerant, and a refrigerant-air heat exchanger that performs heat exchange between the refrigerant and air (hereinafter referred to as "air heat exchanger") 5, which are sequentially connected so as to form a refrigerating cycle through which the refrigerant is circulated.

Also, by switching a flow direction of the refrigerant by using the four-way valve 2, a refrigerating cycle in which the refrigerant is sequentially passed and circulated through the compressor 1, the four-way valve 2, the air heat exchanger 5, the expansion valve 4, a heat storage transfer pipe 7, the wafer heat exchanger 3, the four-way valve 2, and the compressor 1 can be formed.

The heat storage transfer pipe 7 is contained inside a heat storage water tank 8, and a fan for refrigerant-air heat exchanger that feeds air to the air heat exchangers (hereinafter referred to as "airfan") 6 is installed therein.

(Water Circuit)

The water circuit 100*w* has a water inlet pipeline 11 allowing a water source, not shown (such as a public wafer pipeline, for example), to communicate with the water heat exchanger 3, a hot water tank 13, and a water outlet pipeline 12 allowing the wafer heat exchanger 3 to communicate with the hot wafer tank 13.

In the water inlet pipeline 11, a water-source water circulating device (hereinafter referred to as "water feeding pump") 10 is installed, and the water inlet pipeline 11 branching from the water inlet pipeline 11 branches between the water feeding pump 10 and the water heat exchanger 3, and connects to a heat storage water tank water feed pipe 14 communicating with the heat storage water tank 8.

(Heat Storage Water Tank)

The heat storage water tank 8 houses the heat storage transfer pipe 7 and is connected to the heat storage water tank water feed pipe 14 that receives wafer and a heat storage water tank water discharge pipe 22 that discharges wafer, a heat storage water tank water feed opening/closing valve 15 being installed in the former, and a heat storage water tank water discharge opening/closing valve 23 in the latter respectively.

Also, since a water level detecting means 21 is disposed in the heat storage water tank 8, the heat storage water tank water feed opening/closing valve 15 or the heat storage water tank water discharge opening/closing valve 23 may be controlled to open and close on the basis of a detection signal of the water level detecting means 21 so that the water level keeps constant. By means of the opening/closing operation of the heat storage water tank water feed opening/closing valve 15 and the heat storage water tank water discharge opening/closing valve 23, the water can be completely discharged from the heat storage water tank 8 and replaced in full volume.

The heat storage water tank water feed pipe 14 is shown as a branch from the water inlet pipeline 11, but the present invention is not limited to that, and the pipe may communicate with a pipeline different from the water inlet pipeline 11.

(Water Heating Operation)

With respect to FIG. 2, an operation in the heat pump water heater 100 during the water heating operation will be described.

In the refrigerant circuit 100*c*, the refrigerant discharged from the compressor 1 enters the water heat exchanger 3 through the four-way valve 2 and radiates heat to the wafer (heats the water) and then, is fed to the expansion valve 4 as a high-temperature liquid refrigerant through the heat storage transfer pipe 7. The refrigerant which has been decompressed by the expansion valve 4 and brought info a low-temperature two-phase state absorbs heat from the air (cools the air) in the air heat exchanger 5, while its temperature increases, and then, returns to the compressor 1 through the four-way valve 2 (the flow of the refrigerant is indicated by a solid line and a flow direction by an arrow).

In the water circuit 100*w*, the water (hereinafter referred to as "water source water") is fed by the water feeding pump 10 and flows into the water heat exchanger 3 through the water inlet pipeline 11. Then, the water receives warm heat from the refrigerant and is heated and fed to the hot water tank 13 through the water outlet pipeline 12 as heated water (that is, hot wafer).

Also, a part of the water source water supplied to the water heat exchanger 3 is stored in the heat storage wafer tank 8, receives warm heat from the refrigerant passing through the heat storage transfer pipe 7 and is heated (hereinafter, the water source water heated in the heat storage water tank 8 is referred to as "heat storage water" and the flow is indicated by a broken line and the flow direction by an arrow).

(Frosting)

During the water heating operation, if a refrigerant temperature of the air heat exchanger 5 is at a dew point temperature or below of sucked air (the same as the atmosphere sent to the air fan 6) (at 0° C. or below, for example), a frosting phenomenon in which moisture contained in the air adheres to the air heat exchanger 5 and forms frost occurs.

If the frosting phenomenon progresses, a heat exchange amount in the air-heat exchanger 5 is decreased due to an increase in ventilation resistance and an Increase in thermal resistance, and COP and performance are lowered as shown in FIG. 3, whereby a defrosting operation is needed.

(Defrosting Operation)

In FIG. 4, the defrosting operation is performed by stopping the water heating operation once, by switching the four-way valve 2 to a cooling cycle (to deliver cold heat to the water in the water heat exchanger 3), and by directly having a high-temperature and high-pressure gas refrigerant compressed in the compressor 1 flow to the air heat exchanger 5.

That is, the refrigerant corning out of the compressor 1 enters the air heat exchanger 5 through the four-way valve 2 still in the high-temperature and high-pressure gas refrigerant state and radiates the heat in the air heat exchanger 5 (heating the air heat exchanger 5 itself) so as to melt the frost (defrost), and the refrigerant itself is cooled so as to be a liquid refrigerant and flows into the expansion valve 4. The refrigerant having passed through the expansion valve 4 flows into the heat storage transfer pipe 7 and during the passage, it absorbs warm beat from the heat storage water stored in the heat storage water tank 8. Then, the refrigerant passes through the water heat exchanger 3 and returns to the compressor 1 through the four-way valve 2.

At this time, since the refrigerant having passed through the heat storage transfer pipe 7 has been gasified, little heat exchange is performed with the water in the water circuit 100*w* in the wafer heat exchanger 3. Thus, the water source water having flowed into the water heat exchanger 3 is rarely cooled, supply of cold water into the hot water tank 13 is suppressed, and efficiency can be improved.

Also, by opening the heat storage water tank wafer discharge opening/closing valve 23, it becomes possible to replace the heat storage wafer in the heat storage water tank 8, and new water source water can be used all the time, whereby lowered performance caused by aging deterioration can be suppressed.

It may be so configured that, by means of the water level detecting means 21 attached to the heat storage water tank 8, the water level is detected all the time, and opening/closing control of the heat storage water tank water feed opening/closing valve 15 is executed so to keep a wafer level constant.

Also, since there is no need to seal the water source water in advance for shipment of a product, an increase in the product weight at the time of shipping can be suppressed, whereby deterioration of transportation and installation performances can be suppressed.

The refrigerant is not limited and may be any one of a natural refrigerant such as carbon dioxide, hydrocarbon, helium, a refrigerant not containing chloride such as a substitute refrigerant including HFC410A, HFC407C and the like, a fluorocarbon refrigerant such as R22, R134a used in existing products or the like.

Also, the compressor 1 is not limited, any one of various types of compressor such as reciprocating, rotary scroll, and screw compressors may be used, and it may be a variable rotational speed compressor, a fixed rotational speed compressor or a multistage compressor having a plurality of compression chambers.

Embodiment 2

Figure 5:
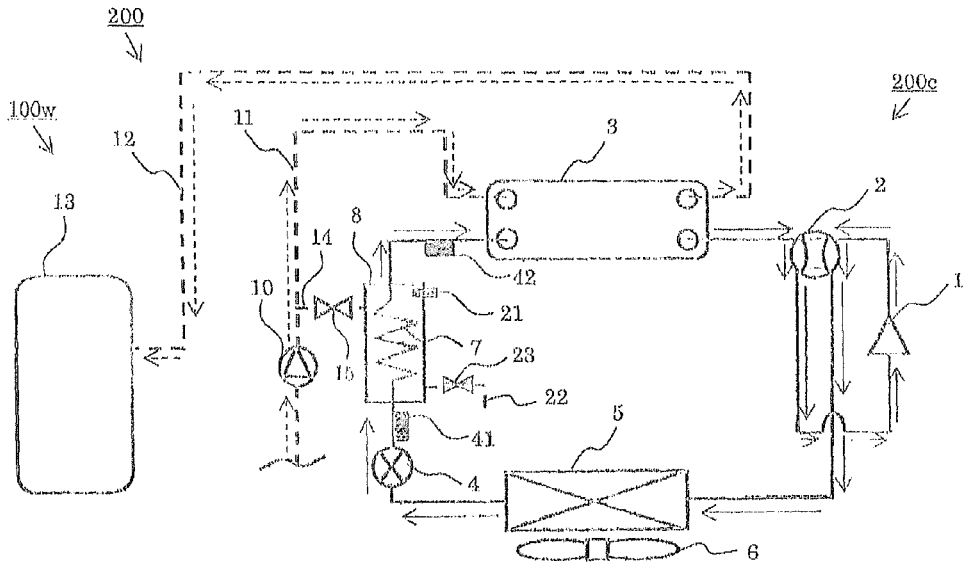
FIG. 5 is a configuration diagram for explaining an operating method of a heat pump water heater according to Embodiment 2 of the present invention.

FIG. 5 is to explain an operating method of a heat pump water heater according to Embodiment 2 of the present invention and is a configuration diagram illustrating refrigerant circuit and water circuit configurations that perform the method. The same or corresponding portions as in Embodiment 1 are given the same reference numerals and a part of the description will be omitted.

In FIG. 5, a heat pump water heater 200 has a refrigerant circuit 200*c* and the water circuit 100*w*.

In the refrigerant circuit 200*c*, first refrigerant temperature defecting means (hereinafter referred to as "first sensor") 41 is installed between the expansion valve 4 and the heat storage transfer pipe 7 and second refrigerant temperature detecting means (hereinafter referred to as "second sensor") 42 between the heat storage transfer pipe 7 and the wafer heat exchanger 3. The configuration excluding the first sensor 41 and the second sensor 42 is the same as that of the heat pump wafer heater 100.

In the heat pump water heater 200, an opening degree of the expansion valve 4 can be adjusted so that a second refrigerant temperature (T2) detected by the second sensor 42 is higher than a first refrigerant temperature (T1) detected by the first sensor 41 (T1<T2). At this time, since the refrigerant passing through the heat storage transfer pipe 7 receives warm heat from the heat storage water, the second refrigerant temperature (T2) is lower than a temperature (Th) of the heat storage wafer (T1<T2<Th). That is, it is controlled such that the first refrigerant temperature (T1), which is a refrigerant temperature at the outlet of the expansion valve 4 during the defrosting operation, is lower than the temperature (Th) of the heat storage water heated during the water heating operation.

As a result, during the defrosting operation, since the refrigerant flowing into the water heat exchanger 3 becomes a gas refrigerant overheated by receiving warm heat, the water is not cooled in the water heat exchanger 3. Therefore, cold water supply to the hot water tank 13 is suppressed, efficiency can be improved, and energy can be saved.

Also, since the refrigerant flowing out of the water heat exchanger 3 is a gas refrigerant, liquid back to the compressor 1 is also suppressed, and an input to the compressor 1 during the defrosting operation is reduced, and the energy can be saved.

Instead of the second sensor 42 installed between the heat storage transfer pipe 7 and the water heat exchanger 3, a fourth refrigerant temperature detecting means may be installed between the water heat exchanger 3 and the compressor 1, and control is made such that a refrigerant temperature (T4) detected by the fourth refrigerant temperature detecting means is higher than the first refrigerant temperature (T1) (T1<T4). At this time, a refrigerant returning to the compressor 1 turns to gas (a state located in the right side of a saturated vapor line in a Mollier chart).

On the other hand, if the refrigerant temperature (T4) is not higher than the first refrigerant temperature (T1), (T1=T4), the refrigerant returning to the compressor 1 is located at a position sandwiched between a saturated liquid line and a saturated vapor line in the Mollier chart and presents a two-phase state.

Embodiment 3

Figure 6:
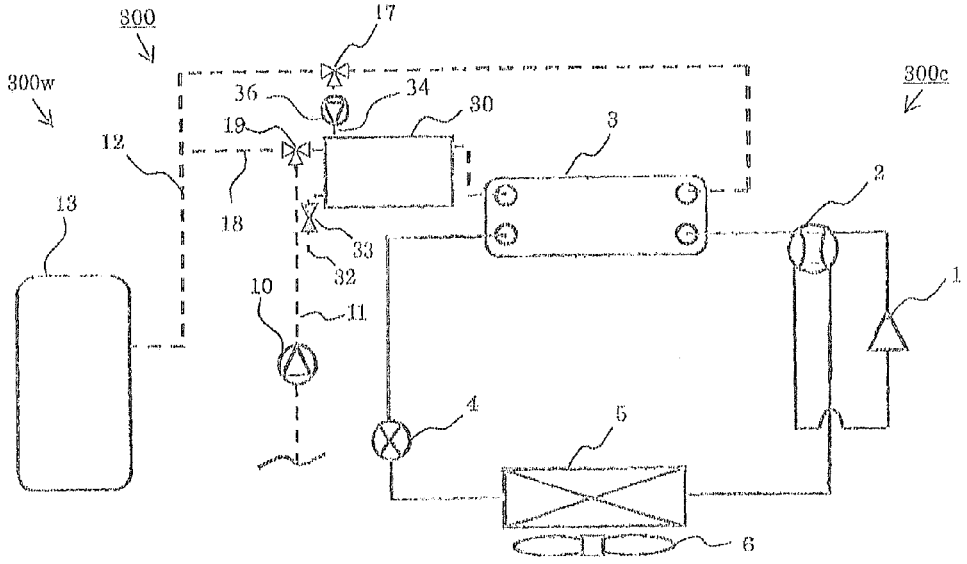
FIG. 6 is a configuration diagram for explaining a heat pump water heater according to Embodiment 3 of the present invention.
Figure 7:
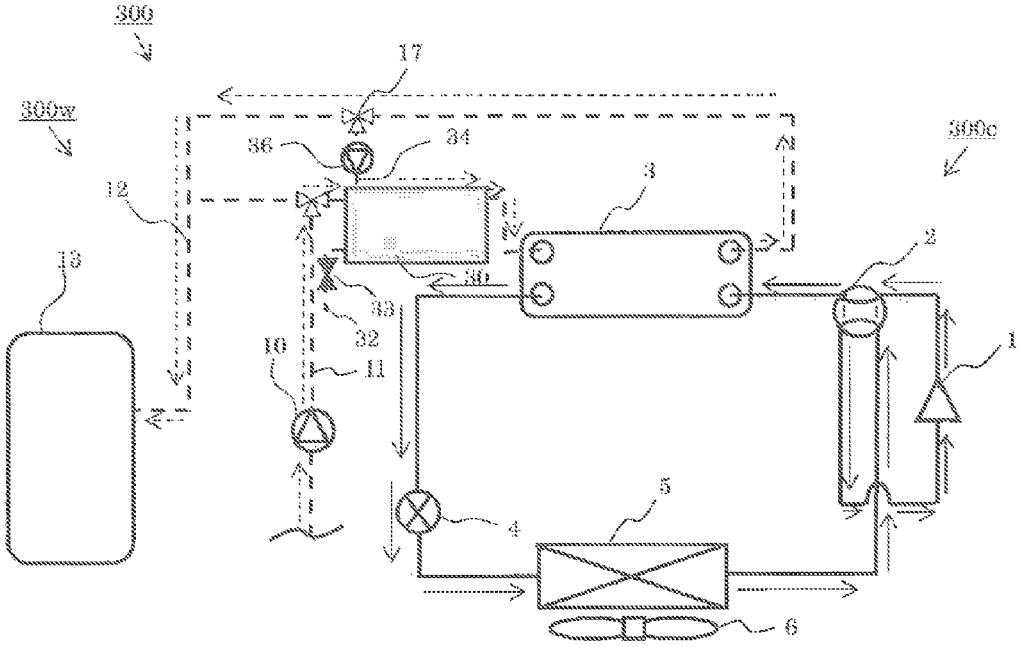
FIG. 7 is a configuration diagram illustrating flows of water and a refrigerant in FIG. 6.
Figure 8:
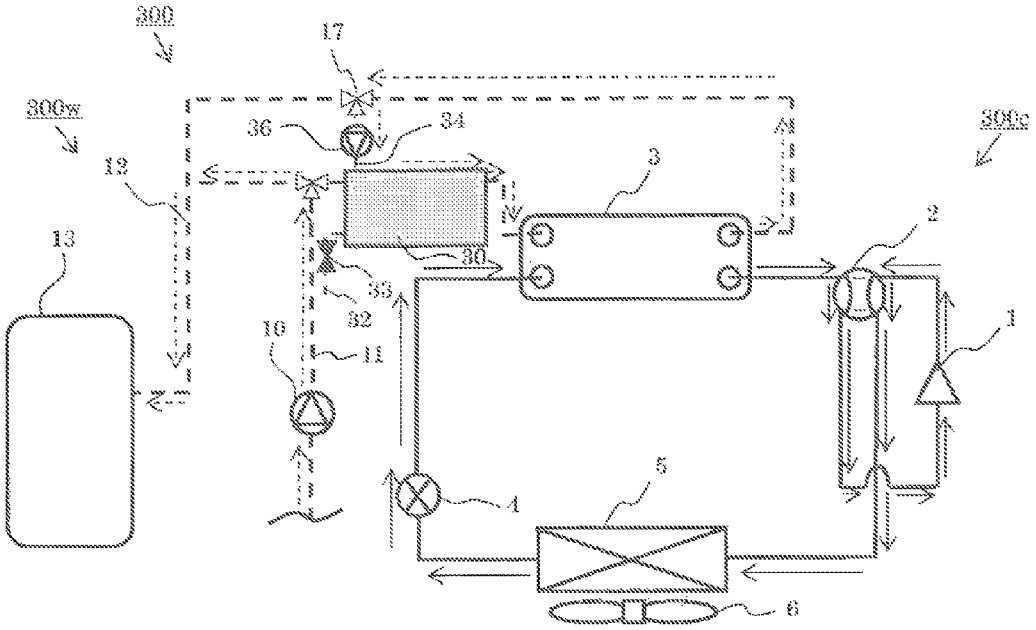
FIG. 8 is a configuration diagram illustrating the flows of the water and the refrigerant in FIG. 8.

FIGS. 6 to 8 are to explain a heat pump water heater according to Embodiment 3 of the present invention, in which FIG. 6 is a configuration diagram illustrating refrigerant circuit and water circuit configurations, and FIGS. 7 and 8 are configuration diagrams illustrating flows of water and the refrigerant. The same or corresponding portions as in Embodiment 1 are given the same reference numerals and a part of the description will be omitted.

In FIG. 6, a heat pump water heater 300 has a refrigerant circuit 300*c* and a water circuit 300*w*.

(Refrigerant Circuit)

The refrigerant circuit 300*c* is equal to the one excluding the heat storage transfer pipe 7 and the heat storage wafer tank 8 from the refrigerant circuit 100*c*.

(Water Circuit)

The water circuit 300*w* has the wafer inlet pipeline 11, the wafer heat exchanger 3, and the water outlet pipeline 12.

In the water inlet pipeline 11, in the order from the upstream side to the downstream side, the water circulating device (hereinafter referred to as "water feeding pump") 10, a bypass three-way valve 19, and a wafer tank 30 are installed.

Also, in the water outlet pipeline 12, a water tank three-way valve 17 is installed. To one of flow outlets of the water tank three-way valve 17, a water tank inflow pipe 34 communicating with the wafer tank 30 is connected, and at the water tank inflow pipe 34, a water tank wafer circulating device (hereinafter referred to as "water storage pump") 36 is installed.

Moreover, to one of the flow outlets of the bypass three-way valve 19, a bypass pipe 18 communicating between the water tank three-way valve 17 of the wafer outlet pipeline 12 and the hot wafer tank 13 is connected.

(Water Tank)

The water tank 30 is disposed in the middle of the water inlet pipeline 11, which is a location where water passes through and a predetermined amount of water can be reserved. Also, a water tank water discharge pipe 32 in which a water tank water discharge opening/closing valve 33 is installed is connected thereto.

Therefore, discharge can be accomplished without having heated water inflow through the water tank inflow pipe 34 or leaving the water source water (or heated water) through the water tank water discharge pipe 32. Thus, since there is no need to seal the water source water in advance at product shipment, an increase of the weight of the product can be suppressed, and deterioration in transportation and installation performances can be suppressed.

(Water Heating Operation)

Referring to FIG. 7, an operation in the heat pump water heater 100 during the water heating operation will be described.

In the refrigerant circuit 100*c*, the refrigerant discharged from the compressor 1 enters the water heat exchanger 3 through the four-way valve 2 and radiates heat to the water (heats the water) and then, becomes a high-temperature liquid refrigerant and is fed to the expansion valve 4. The refrigerant that has been decompressed by the expansion valve 4 and brought into a low-temperature two-phase state absorbs heat from the air (cools air), in the air heat exchanger 5 and then, returns to the compressor 1 through the four-way valve 2 (the flow of the refrigerant is indicated by a solid line and a flow direction by an arrow).

On the other hand, in the water circuit 300*w*, the water source water supplied from the water source is fed by the water feeding pump 10 and passes through the water inlet pipeline 11 and flows into the water heat exchanger 3 through the water tank 30. Then, during the passage through the water heat exchanger 3, the water receives warm heat from the refrigerant and is heated and is fed to the hot water tank 13 through the water outlet pipeline 12 as heated water. At this time, one of the flow outlets of the water tank three-way valve 17 is closed, a water storing pump 36 is stopped, and the water tank water discharge opening/closing valve 33 is closed (the flow of the water is indicated by a broken line and the flow direction by an arrow).

(Defrosting Operation)

In FIG. 8, the defrosting operation is performed by stopping the water heating operation once, by switching the four-way valve 2 to a cooling cycle (to deliver cold heat to the water in the wafer heat exchanger 3), and by directly having a high-temperature and high-pressure gas refrigerant compressed in the compressor 1 flow to the air heat, exchanger 5.

That is, in the refrigerant circuit 300*c*, the refrigerant coming out of the compressor 1 enters the air heat exchanger 5 through the four-way valve 2 still in the high-temperature and high-pressure gas refrigerant state and radiates the heat. In the air heat exchanger 5 (heating the air heat exchanger 5 itself) so as to melt the frost (defrost), and the refrigerant itself is cooled so as to become a liquid refrigerant and flows into the expansion valve 4. The refrigerant having passed through the expansion valve 4 flows into the water heat exchanger 3, receives warm heat from the water in the water circuit 300*w* and then, returns to the compressor 1 through the four-way valve 2.

On the other hand, in the water circuit 300*w*, the wafer feeding pump 10 is stopped, the water tank three-way valve 17 is opened to the water tank inflow pipe 34 side, and since the wafer storing pump 38 is operated, the water flowing out of the water heat exchanger 3 (and cooled by delivering warm heat to the refrigerant (hereinafter referred to as "coded water")), and the cooing water flows into the wafer tank 30, and the water source water stored in the wafer tank 30 is supplied to the water heat exchanger 3.

That is, in the wafer circuit 300*w*, only a circuit circulating between the wafer heat exchanger 3 and the water tank 30 is formed, and the cooled water does not flow into the hot water tank 13.

Therefore, though the temperature of the circulating cooled water is gradually lowered, since the cooled water whose temperature has been lowered does not flow into the hot water tank 13, the temperature of the heated water stored in the hot water tank 13 is not lowered.

And the cooled water cooled by such circulation is heated by similar circulation at the beginning when the operation returns to the wafer heating operation and then, by stopping the circulation and by moving onto the beating water operation, the heated water can be supplied to the hot water tank 13. Alternatively at the time when the defrosting operation is ended, the cooled water may be discharged from the wafer tank 30 so that the water source water is newly stored.

If the heated water is dispensed from the hot water tank 13 in parallel with the defrosting operation, the water feeding pump 10 is operated, and the bypass three-way valve 19 is opened to the bypass pipe 18 side.

Then, since the water source water is directly supplied to the hot water tank 13, though the temperature of the heated water stored in the hot water tank 13 is lowered, a dispensed amount can be ensured.

Also, the heat pump wafer heater 300 becomes capable of replacement of the water in the water tank 30 (water source wafer, heated wafer or cooled water), new wafer source water can be used all the time, and lowered performances caused by aging deterioration can be suppressed. Also, since there is no need to seal the water source wafer in advance at the product shipment, an increase in the product weight at the shipment can be suppressed, whereby deterioration of transportation and Installation performances can be suppressed.

It may be so configured that the water level detecting means is installed in the water tank 30 so as to keep a water level constant similarly to the heat pump water heater 100.

Embodiment 4

Figure 9:
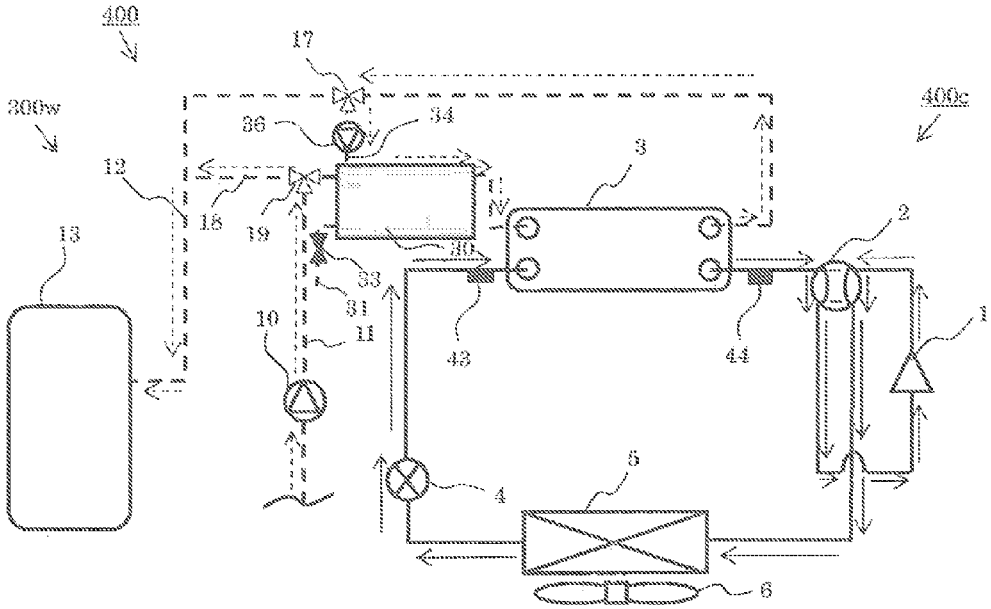
FIG. 9 is a configuration diagram for explaining an operating method of a heat pump water heater according to Embodiment 4 of the present invention.

FIG. 9 is to explain an operating method of a heat pump water heater according to Embodiment 4 of the present invention and is a configuration diagram illustrating refrigerant circuit and water circuit configurations that perform the method. The same or corresponding portions as in Embodiment 3 are given the same reference numerals and a part of the description will be omitted.

In FIG. 9, a heat pump wafer heater 400 has a refrigerant circuit 400*c* and the water circuit 300*w*.

The refrigerant circuit 400*c* has third refrigerant temperature defecting means (hereinafter referred to as "third sensor") 43 disposed between the expansion valve 4 and the water heat exchanger 3 and fourth refrigerant temperature defecting means (hereinafter referred to as "fourth sensor") 44 between the water heat exchanger 3 and the four-way valve 2. The configuration excluding the third sensor 43 and the fourth sensor 44 is the same as that of the heat pump wafer heater 300.

In the heat pomp water heater 400, an opening degree of the expansion valve 4 can be adjusted so that a fourth refrigerant temperature (T4) detected by the fourth sensor 44 is higher than a third refrigerant temperature (T3) detected by the third sensor 43 (T3<T4).

At this time, since the refrigerant passing through the water heat exchanger 3 receives warm heat from the water in the wafer circuit 300*w*, the fourth refrigerant temperature (T4) Is lower than a temperature (Tw) of the water (T3<T4<Tw).

That is, it is controlled such that the third refrigerant temperature (T3), which is a temperature at the outlet of the expansion valve 4 during the defrosting operation, is lower than the temperature (Tw) of the circulating water. Then, during the defrosting operation, since the refrigerant at the outlet of the wafer heat exchanger 3 is brought into a heated state (state located in the right side of a saturated vapor line in a Mollier chart), a heated gas refrigerant always returns to the compressor 1, liquid back is suppressed, and the operation COP during defrosting is improved, whereby an input of the compressor 1 during defrosting is reduced, efficiency is improved, and energy can be saved.

Embodiment 5

Figure 10:
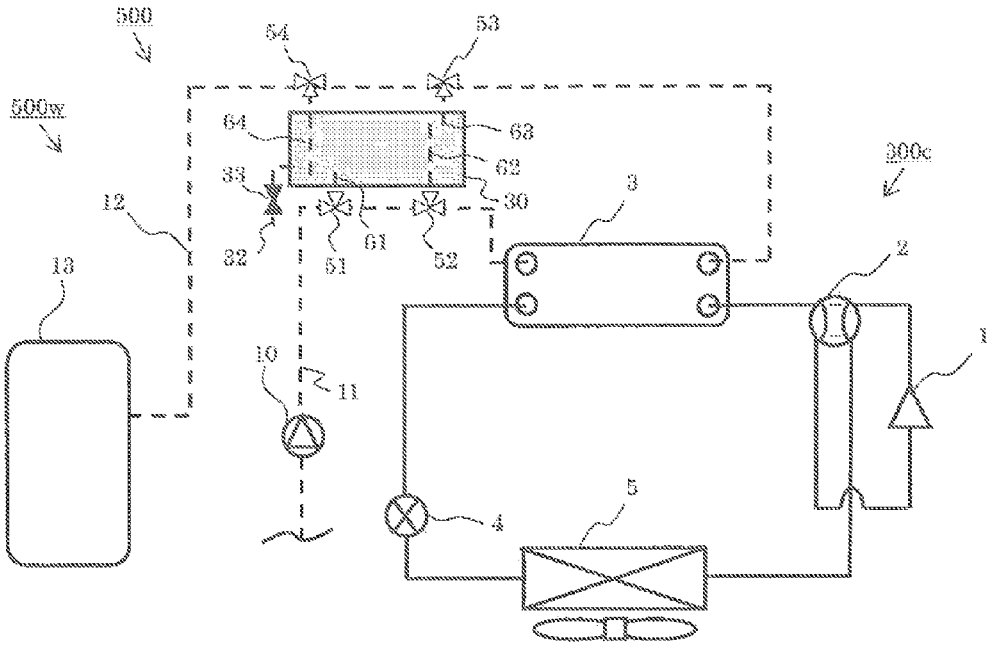
FIG. 10 is a configuration diagram for explaining a heat pump water heater according to Embodiment 5 of the present invention.
Figure 11:
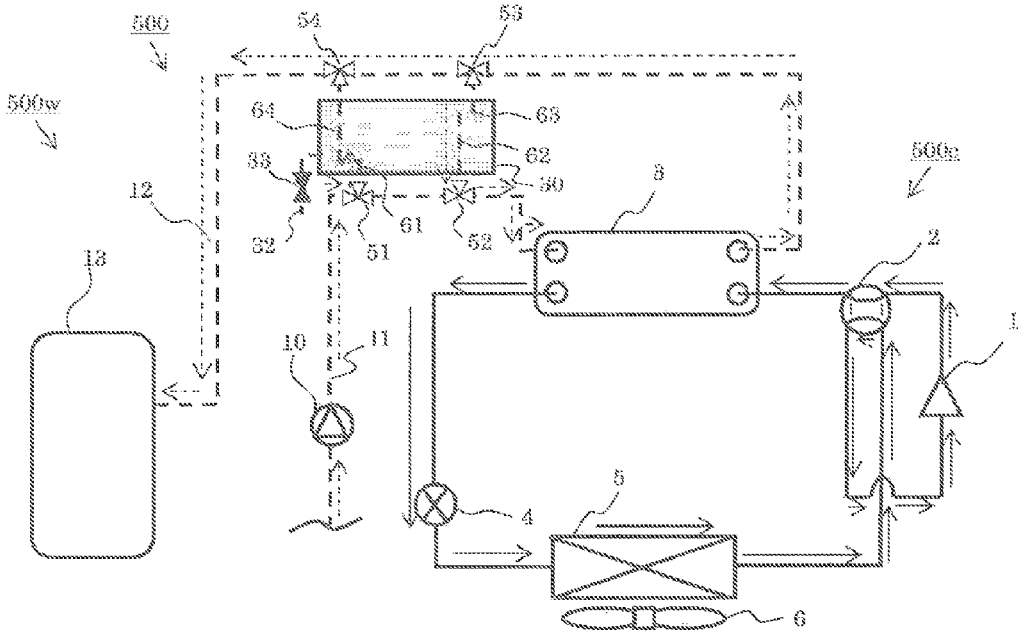
FIG. 11 is a configuration diagram illustrating flows of wafer and a refrigerant in FIG. 10.
Figure 12:
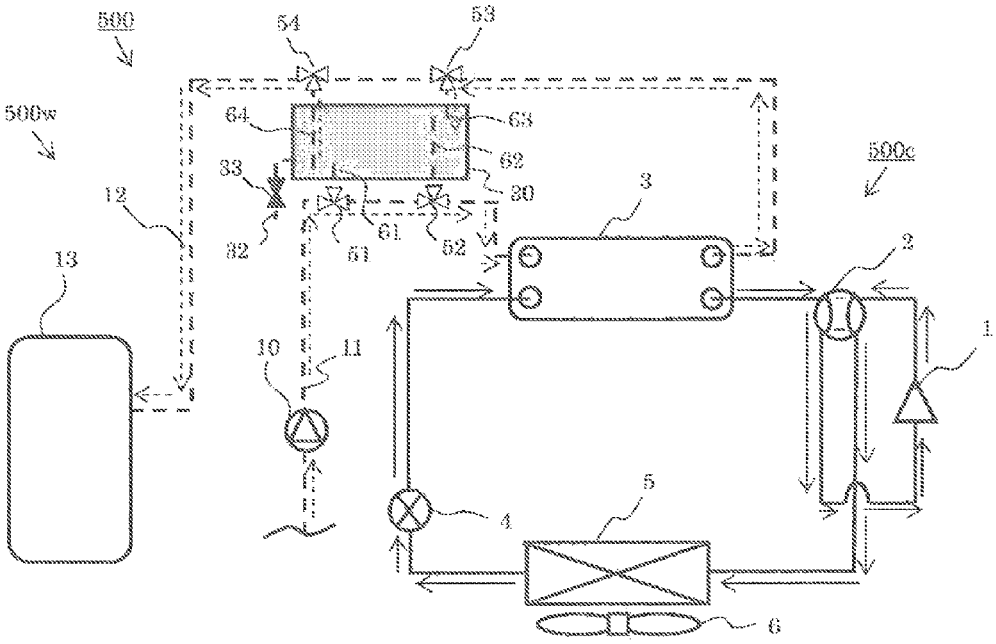
FIG. 12 is a configuration diagram illustrating the flows of the water and the refrigerant in FIG. 10.
Figure 12:
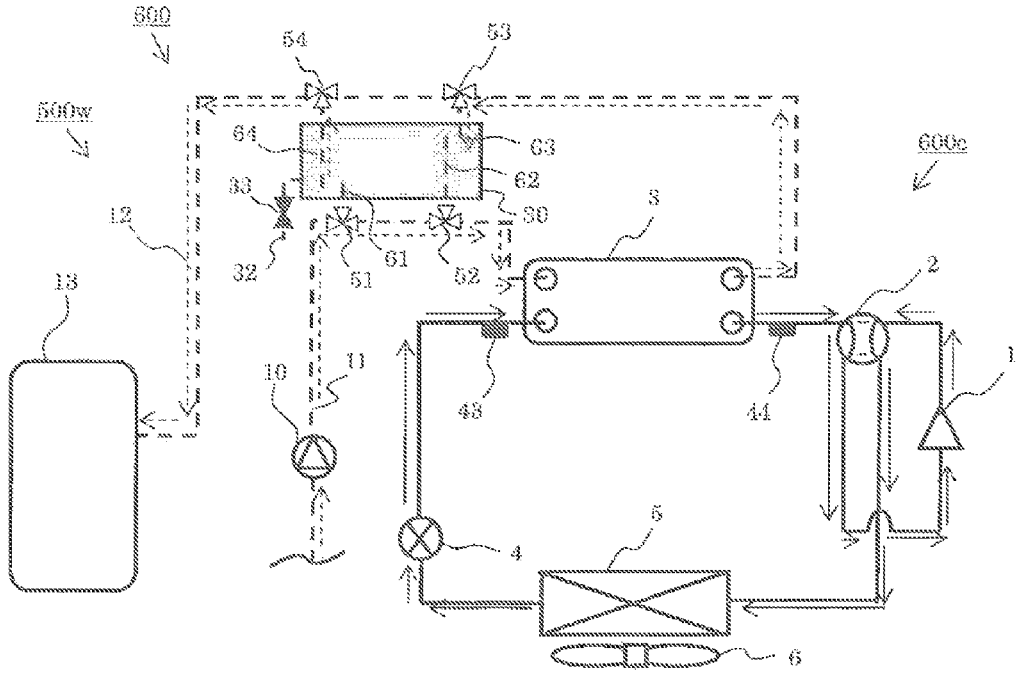

FIGS. 10 to 12 are to explain a heat pump wafer heater according to Embodiment 5 of the present invention, in which FIG. 10 is a configuration diagram illustrating refrigerating circuit and water circuit configurations, and FIGS. 11 and 12 are configuration diagrams illustrating flows of water and a refrigerant. The same or corresponding portions as in Embodiment 3 are given the same reference numerals and a part of the description will be omitted.

In FIG. 10, a heat pump water heater 500 has the refrigerant circuit 300*c* and a water circuit 500*w*.

(Water Circuit)

The wafer circuit 500*w* has the water inlet pipeline 11, the hot water tank 13, the water outlet pipeline 12, and a water tank 30.

In the water inlet pipeline 11, in the order toward the water heat exchanger 3, the water circulating device (hereinafter referred to as "water feeding pump") 10, a wafer tank first three-way valve 51, and a wafer tank second three-way valve 52 are installed. Also, in the wafer outlet pipeline 12, in the order toward the hot water tank 13, a water tank third three-way valve 53 and a water tank fourth three-way valve 54 are installed.

At this time, a path (hereinafter referred to as "hot water feeding path") to the hot water tank 13 through the water feeding pump 10, the water tank first three-way valve 51, the water tank second three-way valve 52, the water heat exchanger 3, the water tank third three-way valve 53, and the water tank fourth three-way valve 54 sequentially is formed.

(Wafer Tank)

Also, to the other outlet of the wafer tank first three-way valve 51 feeding path, the other outlet of the water tank second three-way valve 52, the other outlet of the water tank third three-way valve 53, and the other outlet of the water tank fourth three-way valve 54 on the side not forming the hot water a water tank first inflow pipe 81, a water tank second outflow pipe 82, a water tank third inflow pipe 63, and a wafer tank fourth outflow pipe 64 communicating with the water tank 30 are connected, respectively. Also, to the water tank 30, the water tank water discharge pipe 32 in which the water tank water discharge opening/closing valve 33 capable of discharging the stored water in full volume is installed is connected thereto.

(Water Heating Operation)

Subsequently, an operation of the heat pump water heater 500 will be described.

In FIG. 11, in the refrigerant circuit 300*c*, during the water heating operation, the refrigerant discharged from the compressor 1 enters the water heat exchanger 3 through the four-way valve 2 and radiates heat to the water (lower the temperature) and then, becomes a high-temperature liquid refrigerant and is fed to the expansion valve 4. The refrigerant that has been decompressed by the expansion valve 4 and brought into a low-temperature two-phase state absorbs heat from the air (raises the temperature) in the air heat exchanger 5 and then, returns to the compressor 1 through the four-way valve 2 (the flow of the refrigerant is indicated by a solid line and a flow direction by an arrow).

On the other hand, in the water circuit 500*w*, the water supplied from the water source (hereinafter referred to as "water source water") passes through the water inlet pipeline 11, the wafer tank first inflow pipe 61, the water tank 30, and the water tank second outflow pipe 62 and flows info the water heat exchanger 3. At this time, a predetermined amount of the water source wafer (neither heated nor cooled) is stored in the wafer tank 30. And the water source water having flowed into the water heat exchanger 3 receives warm heat from the refrigerant so as to become heated water during the passage through them and is directly fed to the hot water tank 13 through the water outlet pipeline 12 and supplied (the flows of the water source water and the heated water are indicated by solid lines and flow directions by arrows).

At this time, the water tank first three-way valve 51 communicates with the water tank first inflow pipe 61 side, the water tank second three-way valve 52 communicates with the water tank second outflow pipe 62 side, and the wafer source water passes through the water tank 30. On the other hand, the water tank third three-way valve 53 and the water tank fourth three-way valve 54 are closed on the water tank third inflow pipe 63 side and the water tank fourth inflow pipe 84 side.

(During Defrosting Operation)

In FIG. 12, during the defrosting operation, the water heating operation is stopped once, and the four-way valve 2 is switched to the cooling cycle (the cold heat is delivered to the water in the water heat exchanger 3).

That is, in the refrigerant circuit 300*c*, the refrigerant coming out of the compressor 1 passes through the four-way valve 2, enters the air heat exchanger 5 still in the high-temperature gas refrigerant state and radiates the heat in the air heat exchanger 5 (heating the air heat exchanger 5 itself) so as to melt the frost (defrost) and to become a liquid refrigerant and reaches the expansion valve 4. The refrigerant having passed through the expansion valve 4 flows into the wafer heat exchanger 3, absorbs heat from the water in the water circuit

500*w* during the passage through that (receives warm heat and is heated) and then, returns to the compressor 1 through the four-way valve 2.

On the other hand, in the water circuit 500*w*, the water source water passes through the water inlet pipeline 11 and enters the water heat exchanger 3, gives warm heat to the refrigerant of the refrigerant circuit 300*c* during the passage through that and is cooled (hereinafter the cooled water source water is referred to as "cooled water"). After that, since the wafer tank third three-way valve 53 communicates with the water tank third inflow pipe 63 side, the cooled water having flowed into the wafer outlet pipeline 12 flows into the water tank 30 through that.

At this time, since the water source water is stored in the water tank 30 in advance, and the water tank fourth three-way valve 54 communicates with the water tank fourth outflow pipe 84, with inflow of the cooled water into the water tank 30, the water source water stored in advance in the water tank 30 flows out to the water outlet pipeline 12 through the water tank fourth outflow pipe 84 and is fed to the hot water tank 13.

That is, since the cooled water is not supplied to the hot water tank 13, lowering of the temperature of the heated water stored in the hot water tank 13 is suppressed.

In the above, the case in which the water source water is supplied to the hot water tank 13 is shown, but if the heated water is not dispensed from the hot water tank 13 in parallel with the defrosting operation, the water source wafer is not supplied to the hot water tank 13, but the cooled water may be circulated between the water tank 30 and the water heat exchanger 3.

That is, the wafer tank first three-way valve 51 closes the water tank first inflow pipe 61 side, and the water tank fourth three-way valve 54 closes the wafer tank fourth outflow pipe 64 side, while the water tank second three-way valve 52 opens the water tank second outflow pipe 62 side, and the wafer tank third three-way valve 53 opens the water tank third inflow pipe 63 side.

Then, the cooled water cooled by such circulation is heated by similar circulation at the beginning when the operation returns to the water heating operation and then, by stopping the circulation and by moving onto the heating circulation operation, the heated water can be supplied to the hot water tank 13. Alternatively, at the time when the defrosting operation is ended, the cooled water may be discharged from the water tank 30 so that the water source water is newly stored.

Embodiment 6

FIG. 13 is to explain an operating method of a heat pump water heater according to Embodiment 6 of the present invention and is a configuration diagram illustrating refrigerant circuit and water circuit configurations that perform the method. The same or corresponding portions as in Embodiment 5 are given the same reference numerals and a part of the description will be omitted.

In FIG. 12, a heat pump wafer heater 600 has a refrigerant circuit 600*c* and the water circuit 500*w*.

In the refrigerant circuit 600*c*, third refrigerant temperature defecting means (hereinafter referred to as "third sensor") 43 is disposed between the expansion valve 4 and the water heat exchanger 3 and fourth refrigerant temperature detecting means (hereinafter referred to as "fourth sensor") 44 between the water heat exchanger 3 and the four-way valve 2. The configuration excluding the third sensor 43 and the fourth sensor 44 is the same as that of the heat pump water heater 500.

In the heat pump wafer heater 600, since an opening degree of the expansion valve 4 can be adjusted so that the fourth refrigerant temperature (T4) detected by the fourth sensor 44 is higher than the third refrigerant temperature (T3) detected by the third sensor 43 (T3<T4), the working effects of the heat pump water heater 400 described in Embodiment 4 can be obtained.

REFERENCE SIGNS LIST

1 compressor
2 four-way valve
3 water heat exchanger
4 expansion valve
5 air heat exchanger
6 air fan
7 heat storage transfer pipe
8 heat storage water tank
10 water feeding pump
11 water inlet pipeline
12 water outlet pipeline
13 hot water tank
14 heat storage water tank water feed pipe
15 heat storage water tank water feed opening/closing valve
17 water tank three-way valve
18 bypass pipe
19 bypass three-way valve
21 water-level defecting means
22 heat storage water tank water discharge pipe
23 heat storage water tank water discharge opening/closing valve
30 water tank
32 water tank water discharge pipe
33 wafer tank water discharge opening/closing valve
34 water tank inflow pipe
36 water storing pump
41 first sensor
42 second sensor
43 third sensor
44 fourth sensor
51 water tank first three-way valve
52 water tank second three-way valve
53 water tank third three-way valve
54 water tank fourth three-way valve
61 water tank first inflow pipe
62 water tank second outflow pipe
63 water tank third inflow pipe
64 water tank fourth outflow pipe
100 heat pump wafer heater (Embodiment 1)
100*c* refrigerant circuit
100*w* wafer circuit
200 heat pump wader heater (Embodiment 2)
200*c* refrigerant circuit
300 heat pump water heater (Embodiment 3)
300*c* refrigerant circuit
300*w* water circuit
400 heat pump water heater (Embodiment 4)
400*c* refrigerant circuit
500 heat pump water heater (Embodiment 5)
500*w* wafer circuit
600 heat pump water heater (Embodiment 6)
600*c* refrigerant circuit

The invention claimed is:

1. A heat pump water heater having a refrigerant circuit and a water circuit thermally connected through a refrigerant-water heat exchanger that performs heat exchange between a refrigerant and water, wherein said refrigerant circuit includes a compressor, a four-way valve, said refrigerant-water heat exchanger, expanding means, and a refrigerant-air heat exchanger, forms a water heating circuit composed by sequentially connecting said compressor, said four-way valve, said refrigerant-water heat exchanger, said expanding means, said refrigerant-air heat exchanger, and said four-way valve, and forms a defrosting operation circuit composed by sequentially connecting said compressor, said four-way valve, said refrigerant-air heat exchanger, said expanding means, said refrigerant-water heat exchanger, and said four-way valve by switching of said four-way valve;

said water circuit includes a water inlet pipeline communicating with said refrigerant-water heat exchanger, a water circulating device, a bypass three-way valve, a water tank, and a hot water tank sequentially installed in said water inlet pipeline from the upstream side to the downstream side, the hot water tank, a water outlet pipeline that allows the hot water tank to communicate with said refrigerant-water heat exchanger, a water tank three-way valve installed in the water outlet pipeline, a water tank pipeline that allows one of inlets/outlets of the water tank three-way valve to communicate with said water tank, a water tank water circulating device installed in the water tank pipeline, and a bypass pipeline that allows one of inlets/outlets of said bypass three-way valve, said water tank three-way valve of said water outlet pipeline, and said hot water tank to communicate with each other;

said water circuit is configured to directly enter water having passed through said water inlet pipeline into either said hot water tank or the water tank via said bypass three-way valve;

when said water heating circuit is formed, in said refrigerant circuit, warm heat is delivered to water that flowed into said refrigerant-water heat exchanger from the refrigerant flowing through said refrigerant-water heat exchanger;

in said water circuit, the water having passed through said water inlet pipeline flows into said refrigerant-water heat exchanger via the water tank and is heated and then, directly flows into said hot water tank;

when said defrosting operation circuit is formed, in said refrigerant circuit, after defrosting of said refrigerant-air heat exchanger, the refrigerant having passed through said expanding means receives warm heat from water that flowed into said refrigerant-water heat exchanger and returns to said compressor; and in said water circuit, inflow of water from said water inlet pipeline to the water tank and said hot water tank is stopped, and in said refrigerant-water heat exchanger, the water which has delivered warm heat to the refrigerant flows from one of inlets/outlets of said water tank three-way valve to said water tank through said water tank pipeline and then, returns to said refrigerant-water heat exchanger through said water inlet pipeline; and said water which has delivered warm heat to the refrigerant in said refrigerant-water heat exchanger is stopped flowing into said hot water tank.

2. The heat pump water heater of claim 1, wherein a water tank water discharge pipeline in which a water tank water discharge opening/closing valve is installed is connected to said water tank so that water stored in said water tank can be discharged through the water tank discharge pipeline.

3. The heat pump water heater of claim 1, wherein the water circuit is configured so that hot water in the hot water tank can be used even during the defrosting operation.

4. A method of operating a heat pump water heater having a refrigerant circuit and a water circuit thermally connected through a refrigerant-water heat exchanger that performs heat exchange between a refrigerant and water, wherein said refrigerant circuit includes a compressor, a four-way valve, said refrigerant-water heat exchanger, expanding means, and a refrigerant-air heat exchanger, forms a water heating circuit composed by sequentially connecting said compressor, said four-way valve, said refrigerant-water heat exchanger, said expanding means, said refrigerant-air heat exchanger, and said four-way valve, and forms a defrosting operation circuit composed by sequentially connecting said compressor, said four-way valve, said refrigerant-air heat exchanger, said expanding means, said refrigerant-water heat exchanger, and said four-way valve by switching of said four-way valve, said water circuit includes a water inlet pipeline communicating with said refrigerant-water heat exchanger, a water circulating device, a bypass three-way valve, a water tank, and a hot water tank sequentially installed in said water inlet pipeline from the upstream side to the downstream side, the hot water tank, a water outlet pipeline that allows the hot water tank to communicate with said refrigerant-water heat exchanger, a water tank three-way valve installed in said water outlet pipeline, a water tank pipeline that allows one of inlets/outlets of the water tank three-way valve to communicate with said water tank, a water tank water circulating device installed in the water tank pipeline, and a bypass pipeline that allows one of inlets/outlets of said bypass three-way valve, said water tank three-way valve of said water outlet pipeline, and said hot water tank to communicate with each other, said water circuit is configured to directly enter water having passed through said water inlet pipeline into either said hot water tank or the water tank via said bypass three-way valve, and when said defrosting operation circuit is formed, said expanding means is controlled so that water circulates between said refrigerant-water heat exchanger and said water tank, and the temperature of the refrigerant flowing out of said refrigerant-water heat exchanger is higher than the temperature of the refrigerant flowing out of said expanding means, and inflow of water from said water inlet pipeline to the water tank and said hot water tank is stopped, and said water which has delivered warm heat to the refrigerant in said refrigerant-water heat exchanger is stopped flowing into said hot water tank.

5. The method of claim 4, further comprising:

using hot water in the hot water tank during the defrosting operation.

* * * * *